US012188709B2

(12) United States Patent
Yun

(10) Patent No.: US 12,188,709 B2
(45) Date of Patent: Jan. 7, 2025

(54) REFRIGERATOR

(71) Applicant: LG ELECTRONICS INC., Seoul (KR)

(72) Inventor: Yeongsu Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 184 days.

(21) Appl. No.: 18/102,248

(22) Filed: Jan. 27, 2023

(65) Prior Publication Data

US 2023/0243566 A1 Aug. 3, 2023

(30) Foreign Application Priority Data

Jan. 28, 2022 (KR) ..... 10-2022-0013487

(51) Int. Cl.
*F25C 5/20* (2018.01)
*F25C 1/04* (2018.01)
*F25D 23/06* (2006.01)

(52) U.S. Cl.
CPC ..... *F25C 5/22* (2018.01); *F25C 1/04* (2013.01); *F25D 23/065* (2013.01)

(58) Field of Classification Search
CPC .. F25C 5/22; F25C 1/04; F25D 23/065; F25D 23/04; F25D 2317/062; F25D 2317/0666; F25D 2317/067; F25D 2317/061; F25D 17/065; F25D 17/08; F25D 17/067; F25D 2201/126
See application file for complete search history.

(56) References Cited

U.S. PATENT DOCUMENTS

2010/0251748 A1* 10/2010 Park ..... F25D 23/087 62/407
2013/0305771 A1* 11/2013 Kim ..... F25C 1/00 62/344
2018/0224184 A1* 8/2018 Mitchell ..... F25D 23/067
2021/0148627 A1* 5/2021 Jeong ..... F25D 17/08
2021/0262718 A1* 8/2021 Burlingham ..... F25D 17/065
2022/0065521 A1* 3/2022 Shivappa Thenehalli ..... F25D 11/02
2023/0213260 A1* 7/2023 Alanis ..... F25D 23/04 62/340

* cited by examiner

*Primary Examiner* — Emmanuel E Duke
(74) *Attorney, Agent, or Firm* — KED & Associates LLP

(57) ABSTRACT

The present disclosure relates to a refrigerator that comprises a refrigerator case, a freezer case, a door, an ice maker, an evaporator, and an ice maker duct to supply the cold air that is generated by the evaporator to the ice maker and to return the cold air to the freezer compartment, wherein the ice maker duct comprises an inner ice maker duct and an outer ice maker duct that are divided by a vertical surface formed in a direction in which cold air flows, the inner ice maker duct has an inner convex concave part that is formed convexly and concavely, at an edge thereof, and the outer ice maker duct has an outer convex concave part that is formed convexly and concavely and engages with the inner convex concave part, at an edge thereof.

20 Claims, 16 Drawing Sheets

REFRIGERATOR

CROSS-REFERENCE TO RELATED APPLICATION

This application claims priority under 35 U.S.C. § 119 to Korean Application No. 10-2022-0013487 filed on Jan. 28, 2022, whose entire disclosure is hereby incorporated by reference.

BACKGROUND

1. Field

Disclosed herein is a refrigerator, and in particular, a refrigerator that ensures improvement in the assemblability of a duct.

2. Background

Refrigerators are used to store various types of food items by using cold air that is generated based on the circulation of refrigerants in a refrigeration cycle.

A refrigerator is provided with a single storage compartment or a plurality of storage compartments that are divided, to refrigerate and store a storage target. At this time, the storage compartment can be a storage compartment that is opened and closed by a rotary door or is drawn or stored like a drawer.

In particular, the storage compartment can include a freezer compartment for keeping a storage target frozen, and a refrigerator compartment for keeping a storage target cold, and can include two or more freezer compartments or two or more refrigerator compartments.

Additionally, in recent years, an ice maker is provided at a door of the refrigerator, such that the user can take out ice without opening the freezer compartment. A duct for the ice maker delivers and returns cold air having passed through an evaporator in a cabinet until the cold air reaches the door of the refrigerator compartment, and if the door of the refrigerator compartment is closed, the duct for the ice maker supplies the cold air to the ice maker through a connection flow path provided at the door of the refrigerator compartment.

The duct is injection-molded to have two parts since the duct has a flow path in which cold air flows. As a time of assembly, the two parts are coupled to each other with a tape or a screw and the like. However, the assemblability of the two parts is not ensured sufficiently, and a foam insulator, foaming and filling around the two parts, is drawn into the gap between the two parts.

BRIEF DESCRIPTION OF THE DRAWINGS

The embodiments will be described in detail with reference to the following drawings in which like reference numerals refer to like elements wherein.

DETAILED DESCRIPTION

Technical Problems

Figure 1:
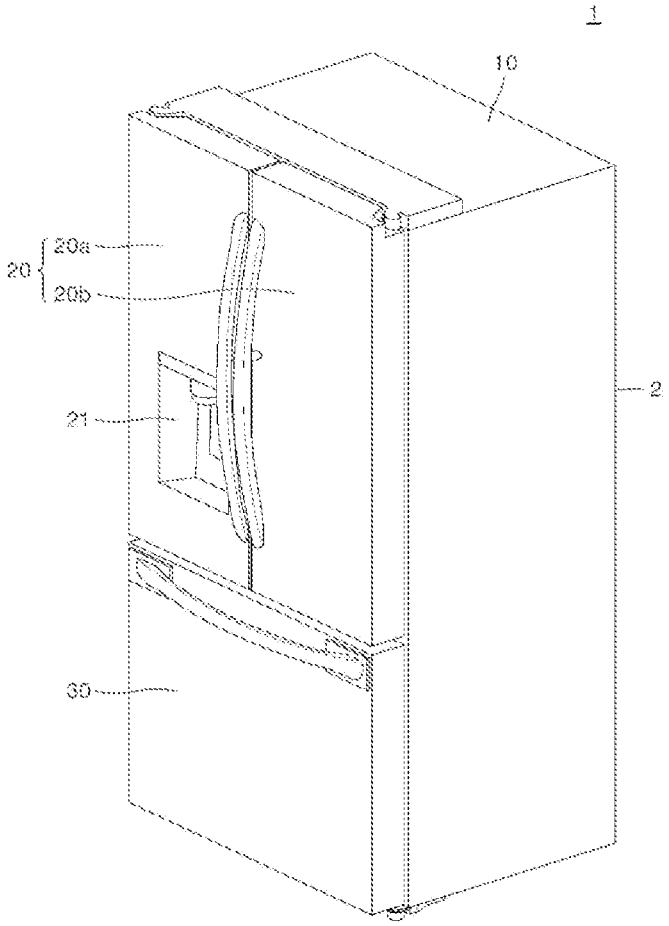
FIG. 1 is a front perspective view showing a refrigerator of one embodiment.

The objective of the present disclosure is to provide a refrigerator that ensures improvement in the assemblability of a duct that is divided into two parts.

Aspects according to the present disclosure are not limited to the above ones, and other aspects and advantages that are not mentioned above can be clearly understood from the embodiments set forth herein. Additionally, the aspects and advantages in the present disclosure can be realized via components and combinations thereof that are described in the appended claims.

Technical Solutions

A refrigerator of an embodiment comprises a refrigerator case forming a refrigerator compartment, a freezer case being disposed at a lower side of the refrigerator case and forming a freezer compartment, a door being disposed at a front of the refrigerator case, and opening and closing the refrigerator case, an ice maker being disposed at the door and generating ice, an evaporator being disposed at a rear of the freezer case and generating cold air, and an ice maker duct supplying the cold air that is generated by the evaporator to the ice maker and returning the cold air to the freezer compartment, wherein the ice maker duct comprises an inner ice maker duct and an outer ice maker duct that are divided by a vertical surface formed in a direction in which cold air flows, the inner ice maker duct has an inner convex concave part that is formed convexly and concavely, at an edge thereof, and the outer ice maker duct has an outer convex concave part that is formed convexly and concavely and engages with the inner convex concave part, at an edge thereof.

Particulars of another embodiment are included in the detailed description and the drawings.

Advantageous Effects

A refrigerator according to the present disclosure has one or more of the following effects.

First, a convex concave par is formed in a portion where duct parts are coupled to each other, such that a foam insulator, foaming and filling around the duct parts, is not drawn into the gap between the duct parts, without a bolding process or a taping process.

Second, the duct parts are assembled to each other without an additional fastening means such as a screw or a tape, thereby ensuring improvement in productivity.

Third, structures in the ducts are designed properly, thereby minimizing the frictional resistance of a flow path of cold air flowing in the ducts and the flow loss of cold air.

The above-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components are not limited by the terms. Certainly, a first component can be a second component, unless stated to the contrary.

Throughout the disclosure, each component can be provided as a single one or a plurality of ones, unless explicitly stated to the contrary.

When any one component is described as being "in the upper portion (or lower portion)" or "on (or under)" another component, any one component can be directly on (or under) another component, but an additional component can be interposed between any one component and another component on (or under) any one component.

When any one component is described as being "connected", "coupled", or "connected" to another component, any one component can be directly connected or coupled to another component, but an additional component can be "interposed" between the two components or the two components can be "connected", "coupled", or "connected" by an additional component.

The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the phrase "A and/or B" as used herein can denote A, B or A and B, and the phrase "C to D" can denote C or greater and D or less, unless stated to the contrary.

Hereafter, a refrigerator of one embodiment is described.

Figure 2:
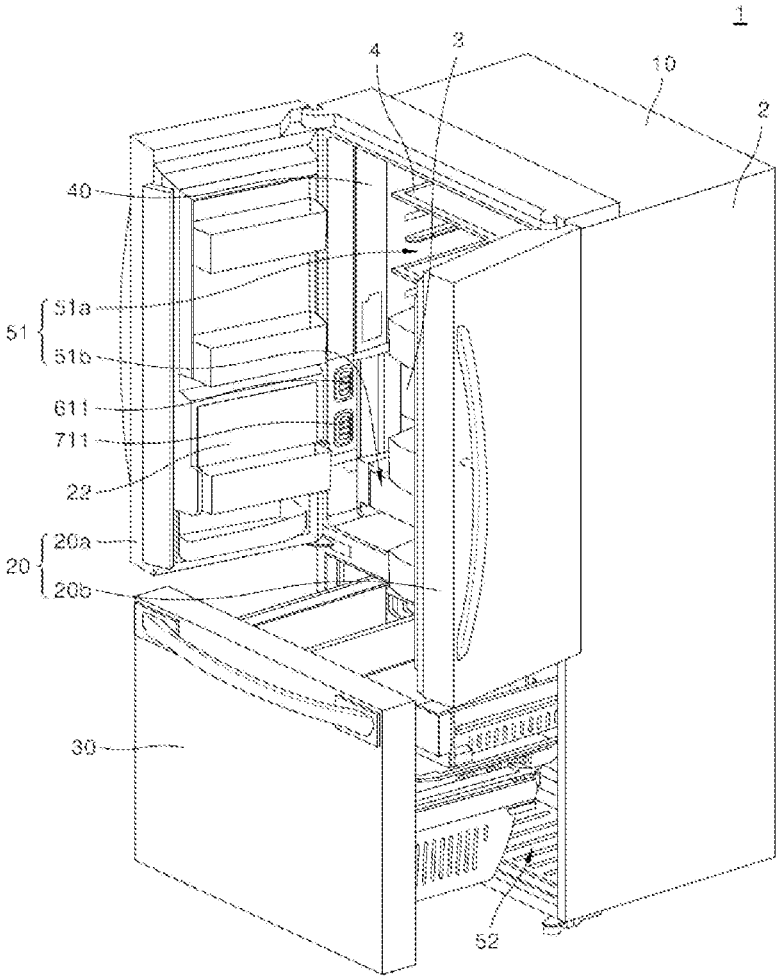
FIG. 2 is a front perspective view showing the refrigerator of one embodiment with doors open.

FIG. 1 is a front perspective view showing a refrigerator of one embodiment, and FIG. 2 is a front perspective view showing the refrigerator of one embodiment with doors open.

The exterior of the refrigerator 1 may be formed by a cabinet 2 that can form a storage space, and doors that can open and close an open front surface of the cabinet 2.

The cabinet 2 may comprise an outer case 10 forming the exterior of the refrigerator 1, and an inner case 40 forming the interior of the refrigerator 1.

The outer case 10 and the inner case 40 may have a separation space therebetween, and a foam insulator foams in the separation space, such that the separation space is filled with the foam insulator.

The storage space in the cabinet 2 may be divided into a plurality of spaces, and may be divided into a refrigerator compartment 51 and a freezer compartment 52.

According to the present disclosure, a freezer compartment 52 is disposed in the lower space of the cabinet 2, and a refrigerator compartment 51 is disposed in the upper space of the cabinet 2, in an example.

A door may connect to the front surface of the cabinet 2, and open and close the refrigerator 1.

An upper door 20 may be disposed on the front surface of the refrigerator 1, corresponding to the refrigerator compartment 51, and a lower door 30 may be disposed on the front surface of the refrigerator 1, corresponding to the freezer compartment 52.

For example, the upper door 20 may be a rotary type one comprised of a first upper door 20*a* and a second upper door 20*b* that respectively have a rotation axis at both sides of the cabinet 2 and rotate around the rotation axis.

The lower door 30 may be a drawer type one that moves along a rail in a sliding manner, to be drawn or stored.

A dispenser part 21 may be disposed at the first upper door 20*a* to take out water or ice, without opening the door. An ice maker 22 generating ice is disposed at the first upper door 20*a* at which the dispenser part 21 is disposed.

Additionally, a supply duct outlet 611 supplying cold air to the ice maker 22, and a return duct inlet 711 returning cold air of the ice maker 22 may be disposed at one surface of the inside of the inner case 40 that connects to the first upper door 20*a*. The supply duct outlet 611 and the return duct inlet 711 may communicate with one side surface of the ice maker 22, with the first upper door 20*a* closed.

The refrigerator compartment 51 may be divided into a first storage compartment 51*a* and a second storage compartment 51*b*.

The second storage compartment 51*b* may be a pantry compartment where a temperature can be adjusted to accommodate a specific storage object such as vegetables or meat and the like.

The first storage compartment 51*a* may denote the rest space of the refrigerator 51, except for the second storage compartment 51*b*, and may be a main storage comportment.

For example, the second storage compartment 51*b* may be disposed under the first storage compartment 51*a*, and as an additional space, may be separated from the first storage compartment 51*a* by an additional partition member.

A storage drawer 3 may be disposed in the second storage compartment 51*b*, and move along a rail in a sliding manner to be drawn or stored.

Additionally, a storage drawer 3 or a shelf 4 is provided in the first storage compartment 51*a*, and accommodate and store a storage object easily.

The first storage compartment 51*a* and the second storage compartment 51*b* may be respectively provided with a temperature sensor, and their temperature may be adjusted independently such that first storage compartment 51*a* and the second storage compartment 51*b* have a different temperature.

Figure 3:
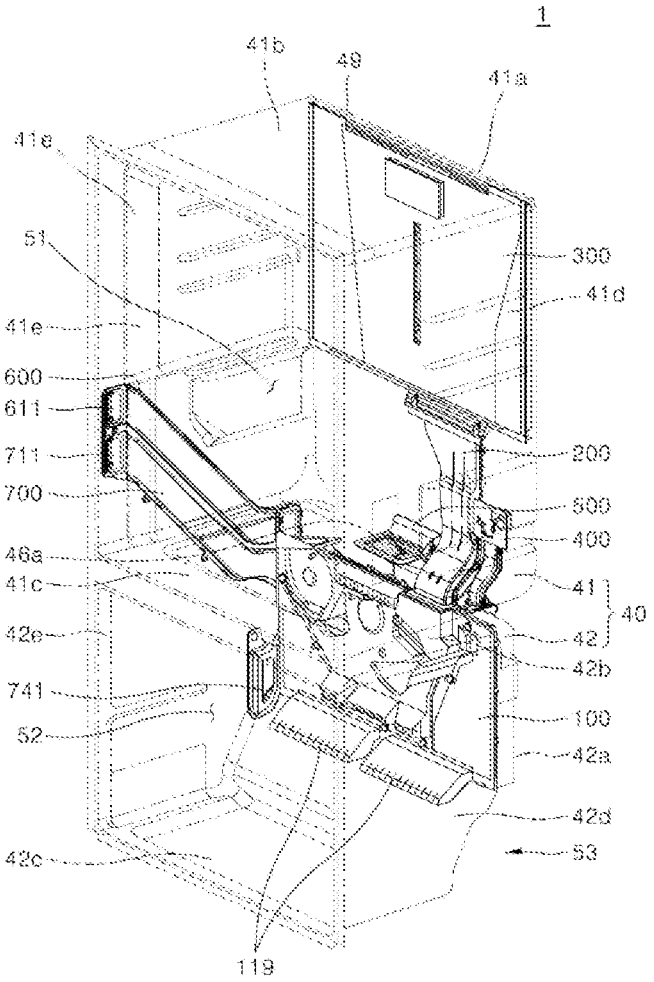
FIG. 3 is a front perspective view showing that an inner case, various types of ducts and a grille fan assembly are coupled in the refrigerator of one embodiment.
Figure 4:
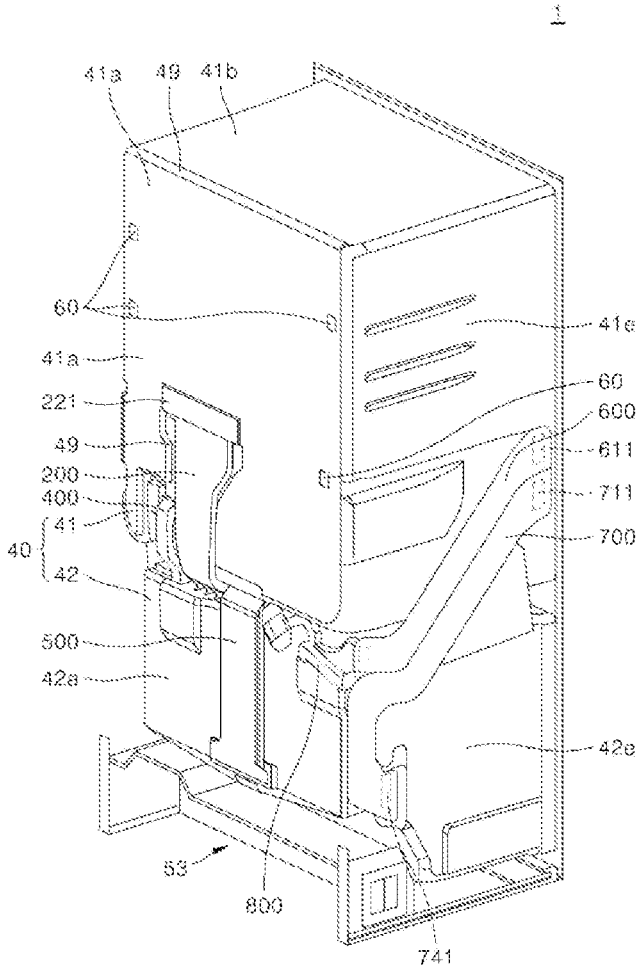
FIG. 4 is a rear perspective view showing that an inner case, various types of ducts and a grille fan assembly are coupled in the refrigerator of one embodiment.
Figure 5:
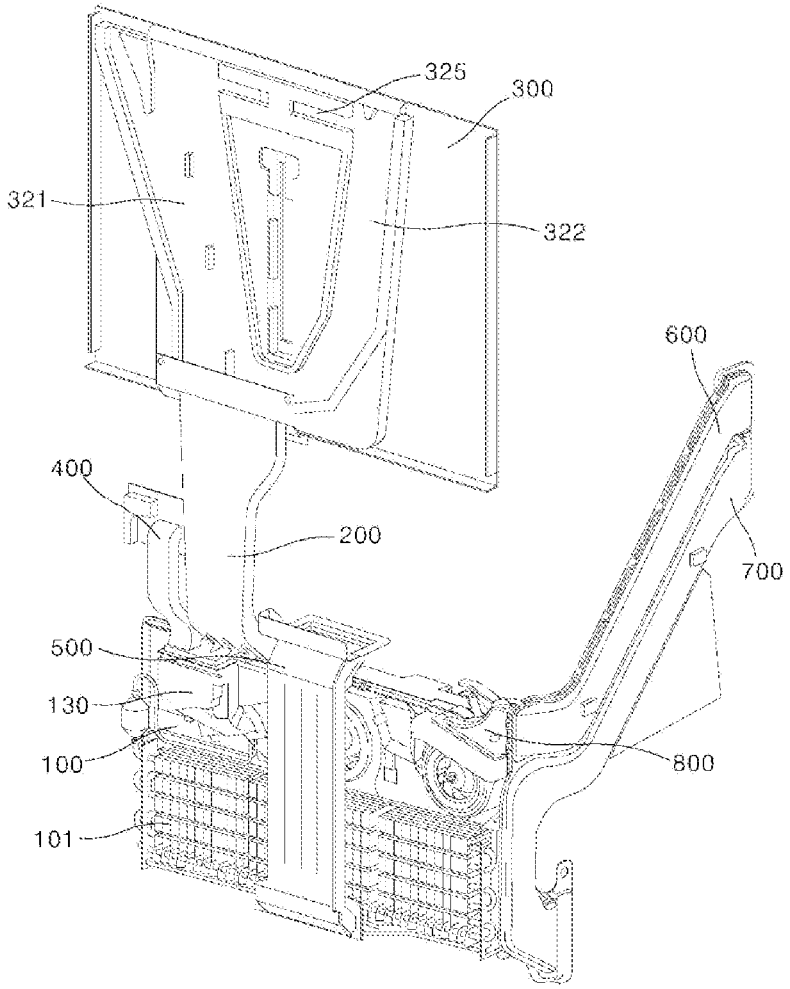
FIG. 5 is a rear perspective view showing that various types of ducts and a grille fan assembly are coupled in the refrigerator of one embodiment.

FIG. 3 is a front perspective view showing that an inner case, various types of ducts and a grille fan assembly are coupled in the refrigerator of one embodiment, FIG. 4 is a rear perspective view showing that an inner case, various types of ducts and a grille fan assembly are coupled in the refrigerator of one embodiment, and FIG. 5 is a rear perspective view showing that various types of ducts and a grille fan assembly are coupled in the refrigerator of one embodiment.

The inner case 40 may be partitioned to comprise a refrigerator case 41 being disposed in the upper portion of the inner case 40 and forming the refrigerator compartment 51, and a freezer case 42 being disposed in the lower portion of the inner case 40 and forming the freezer compartment 52.

Cold air generated in a single evaporator 101 may be supplied to both of the refrigerator compartment 51 and the freezer compartment 52.

If the ice maker 22 is additionally provided at the upper door 20 of the refrigerator 1, cold air generated in a single evaporator 101 may be supplied to all the refrigerator compartment 51, the freezer compartment 52 and the ice maker 22.

The evaporator 101 producing cold air may be disposed at the freezer compartment 52, and specifically, disposed on a rear surface 42*a* of the freezer case, inside the freezer case 42.

The evaporator 101 may be disposed in the upper portion of a machinery room 53.

The machinery room 53 may be provided at the rest side of the lower portion of the freezer case 42, and provide a space for installing a compressor, a condenser, and an expansion side.

The space at the rear of the lower portion side in the freezer compartment 52 may have a freezing space that is less than the space at the rear of the upper portion side in the freezer compartment 52 by the space occupied by the machinery room 53.

That is, an upper surface 42*b* of the freezer case has a surface area that is greater than a lower surface 42*c* of the freezer case.

Accordingly, the area of the upper portion side of the freezer compartment 52 may protrude further rearward than the area of the lower portion side of the freezer compartment 52, and the evaporator 101 may be disposed in the space at the rear of the upper portion side of the freezer compartment 52.

The grille fan assembly 100 may be disposed on the front surface of the evaporator 101, and blow the cold air that is generated by the evaporator to the refrigerator compartment 51 and the freezer compartment 52.

In the case where the ice maker 22 is provided at the upper door 20 of the refrigerator 1, cold air generated from a single evaporator 101 may be blown from a single grille fan assembly 100 to all the refrigerator compartment 51, the freezer compartment 52, and the ice maker 22.

In the refrigerator 1 of the present disclosure, cold air generated from a single evaporator 101 at the freezer compartment 52 may be supplied to the refrigerator compartment 51 as well as the freezer compartment 52.

Accordingly, no space where an additional evaporator 101 is disposed is required in the refrigerator compartment 51, resulting in an increase in the volume of the refrigerator compartment 51.

To blow cold air to a refrigerator compartment supply duct 300 supplying cold air to the refrigerator compartment 51, a connection duct 200 may be additionally disposed between the grille fan assembly 100 and the refrigerator compartment supply duct 300.

One end of the connection duct 200 connects to the grille fan assembly 100, and the other end f the connection duct 200 connects to the refrigerator compartment supply duct 300, such that cold air, being blown from the grille fan assembly 100, is guided to the refrigerator compartment supply duct 300.

The refrigerator compartment supply duct 300 may be disposed inside the refrigerator case 41, the connection duct 200 may be disposed outside the refrigerator case 41, and the refrigerator compartment supply duct 300 and the connection duct 200 may communicate with each other, on a rear surface 41*a* of the refrigerator case.

A foam insulator may foam in the space between the inner case 40 and the outer case 10 and fill the space.

The connection duct 200 may be disposed to pass through the space between the inner case 40 and the outer case 10, which foams with the foam insulator, and buried into the space between the inner case 40 and the outer case 10.

Accordingly, as the upper door 20 of the refrigerator 1 is opened, the connection duct 200 outside the refrigerator case 41 may not be exposed outward, while the refrigerator compartment supply duct 300 inside the refrigerator case 41 may be exposed outward.

A rear surface protrusion part 43 may be disposed on the rear surface 41*a* of the refrigerator case, and protrude toward the inside of the refrigerator case 41, to allow at least a partial area of the connection duct 200 to be inserted from the outside of the refrigerator case 41.

The rear surface protrusion part 43 may have a shape corresponding to the shape of the connection duct 200 such that the connection duct 200 is inserted into the rear surface protrusion part 43.

The rear surface protrusion part 43 may be elongated along the rear surface 41*a* of the refrigerator case toward an upper surface 41*b* of the refrigerator case from a lower surface 41*c* of the refrigerator case.

Since the refrigerator compartment supply duct 300 is disposed inside the refrigerator case 41, the volume of the refrigerator case 41 decreases, as the surface area occupied by the refrigerator compartment supply duct 300 increases.

In particular, since the refrigerator compartment supply duct 300 comprises a cold air flow path through which cold air passes, dew may be formed as cold air passes through the refrigerator compartment 51 having a relatively high temperature and a relatively high humidity. To prevent this from happening, the refrigerator comprises an insulation member of a predetermined thickness.

To increase the volume of the refrigerator case 41, the surface area, occupied by the refrigerator compartment supply duct 300 inside the refrigerator case 41, needs to decrease.

The refrigerator compartment supply duct 300 according to the present disclosure is elongated from the lower surface 41*c* of the refrigerator case to the upper surface 41*b* of the refrigerator case, and is not disposed on the rear surface 41*a* of the refrigerator case.

A rear surface protrusion part 43 is elongated along the rear surface 41*a* of the refrigerator case from the lower surface 41*c* of the refrigerator case toward the upper surface 41*b* of the refrigerator case up to a predetermined height.

Since the connection duct 200 is disposed on the back surface of the rear surface protrusion part 43, the connection duct 200 is disposed outside the refrigerator case 41, rather than inside the refrigerator case 41.

Accordingly, an additional area protruding toward the inside of the refrigerator case 41 except for the rear surface protrusion part 43 may decrease up to the height at which the rear surface protrusion part 43, into which the connection duct 200 is inserted, is formed, and the volume of the refrigerator case may increase.

The rear surface protrusion part 43 may be elongated up to a height close to the central area with respect to the up-down direction of the refrigerator case 41, but not limited.

For example, the rear surface protrusion part 43 may be elongated from the lower surface 41*c* of the refrigerator case up to the height at which the rear surface protrusion part 43 is covered by the storage drawer 3 disposed in the refrigerator case 41.

Further, the rear surface protrusion part 43 may be also be covered by the second storage compartment 51*b* formed in the lower area of the refrigerator case 41.

Thus, the rear surface protrusion part 43 may be elongated from the lower surface 41*c* of the refrigerator case up to the height at which the rear surface protrusion part 43 is covered by the second storage compartment 51*b* and the storage drawer 3 disposed on the second storage compartment 51*b*.

The rear surface protrusion part 43 is not formed in a way that the area of the rear surface 41*a* of the refrigerator case protrudes evenly, but protrudes to correspond to the connection duct 200, causing deterioration in aesthetic qualities.

The second storage compartment 51*b* and the storage drawer 43 are disposed on the front surface of the rear surface protrusion part 43, up to the height at which the rear surface protrusion part 43 is formed. Thus, even when the upper door 20 is opened, the rear surface protrusion part 43 is not exposed, ensuring improvement in the aesthetic qualities of the inside of the refrigerator 1.

Additionally, since the connection duct 200 is disposed to pass through the space between the inner case 40 and the outer case 10, which foams with the foam insulator, an additional insulation member for preventing the heat exchange between the connection duct 200, through which cold air passes, and the refrigerator compartment 51 may not be required.

For the refrigerator 1 to have an insulation effect, a foam insulator exhibiting a very low thermal conductivity foams between the inner case 40 and the outer case 10, to fill the space between the inner case 40 and the outer case 10.

If the connection duct 200 is disposed inside the refrigerator case 41, an insulation member having a predetermined thickness may insulate the connection duct 200.

However, in one embodiment of the present disclosure, the connection duct 200 may be buried in a way that the connection duct 200 passes through the space between the inner case 40 and the outer case 10, which foams with a foam insulator.

Accordingly, in one embodiment of the present disclosure, an additional insulation member for thermally insulating the connection duct 200 is not required, and a foam insulator foaming between the inner case 40 and the outer case 10 can produce a sufficient insulation effect.

In one embodiment of the present disclosure, an additional insulation member for allowing the connection duct 200 to produce an insulation effect is not required, resulting in a significant reduction in the thickness of the connection duct 200.

Accordingly, the thickness of the rear surface protrusion part 43 protruding toward the inside of the refrigerator case 41 decreases significantly, and the volume of the refrigerator compartment 51 may increase.

In the refrigerator 1 of one embodiment, the connection duct 200 and the refrigerator compartment supply duct 300 communicate with each other on the rear surface of the refrigerator case 41, with the refrigerator case 41 therebetween, such that the surface area occupied by the refrigerator compartment supply duct 300 inside the rear surface 41*a* of the refrigerator case decreases.

Thus, the refrigerator 1 of one embodiment may ensure an increase in the volume of the refrigerator compartment 51.

The refrigerator 1 according to the present disclosure may comprise a refrigerator compartment return duct 500 that returns cold air of the refrigerator compartment 51 and supplies the cold air to the evaporator 101.

One end of the refrigerator compartment return duct 500 may connect to the freezer compartment 52, while the other end of the refrigerator compartment return duct 500 connects to the refrigerator compartment 51, and one end and the other end of the refrigerator compartment return duct 500 may be disposed to overlap each other in the up-down direction.

One end of the refrigerator compartment return duct 500 may communicate with the freezer compartment 52 through a refrigerator compartment cold air return communication outlet 46*b* that is disposed on the rear surface 42*a* of the freezer case.

The refrigerator compartment return duct 500 may pass the rear surface of the evaporator 101.

If the refrigerator compartment return duct 500 is too close to the evaporator 101, ice formation may occur. To prevent this from happening, the refrigerator compartment return duct 500 may be spaced a predetermined distance apart from the evaporator 101.

In particular, since the refrigerator compartment return duct 500 comprises a cold air flow path that is used to return cold air of the refrigerator compartment having a relatively high temperature and a relatively high humidity, it is highly likely that ice formation occurs at the refrigerator compartment return duct 500.

To prevent this from happening, one end and the other end of the refrigerator compartment return duct 500 are disposed to overlap each other in the up-down direction, to have the shortest cold air flow path.

Additionally, both side surfaces of the refrigerator compartment return duct 500 have the least curved shapes and are formed into straight lines that are parallel with each other. Accordingly, in terms of the refrigerator compartment return duct 500, the cold air flow path corresponding to the area where the refrigerator compartment return duct 500 overlaps the evaporator 101 may have the shortest length.

Thus, in the refrigerator compartment return duct 500 according to the present disclosure, the cold air flow path overlapping the evaporator 101 has the shortest length, reducing the possibility of ice formation.

Further, the refrigerator compartment return duct 500 according to the present disclosure may make cold air passing through the refrigerator compartment return duct 500 frost evenly rather than being biased by the evaporator 101 to one side, or not frost.

One end and the other end of the refrigerator compartment return duct 500 may be disposed to pass the centers of the refrigerator compartment 51 and the freezer compartment 52 with respect to the left-right direction.

A refrigerator compartment cold air return communication opening 61 is disposed on the lower surface 41*c* of the refrigerator case and communicates with the other end of the refrigerator compartment return duct 500. The refrigerator compartment cold air return communication opening 61 may be disposed to pass the center of the refrigerator compartment 51.

Since one end and the other end of the refrigerator compartment return duct 500 are disposed to pass the centers of the refrigerator compartment 51 and the freezer compartment 52 with respect to the left-right direction, the entire balance of cold air of the refrigerator 1 may be ensured.

The refrigerator compartment return duct 500 returns cold air that is supplied to the refrigerator compartment 51 and circulates in the refrigerator compartment 51, to the freezer compartment 52.

Since the other end of the refrigerator compartment return duct 500, which communicates with the refrigerator compartment cold air return communication opening 61 communicating used to return cold air from the refrigerator compartment 51, is disposed to pass the center of the refrigerator compartment 51, the cold air flows naturally.

The above-described connection duct 200 may be disposed between the refrigerator compartment return duct 500, and the other side surface 41*d* of the refrigerator case that is one side surface of the refrigerator compartment 51, with respect to the left-right direction.

In the case of a connection duct 200 one end of which connects to the freezer compartment 52 and the other end of which connects to the refrigerator compartment 51, the width of the cold air flow path may increase from one end of the connection duct 200 toward the other end of the connection duct 200.

At this time, the width of the cold air flow path of the connection duct 200 may increase further toward the center of the refrigerator compartment 51.

Additionally, the other end of the connection duct 200 may be disposed to pass the center f the refrigerator compartment 51 in the left-right direction.

While the connection duct 200 is disposed between the refrigerator compartment return duct 500 and one side surface of the refrigerator compartment 51, the width of the cold air flow path of the connection duct 200 increases further toward the center of the refrigerator compartment 51. Accordingly, the entire balance of cold air of the refrigerator 1 may be ensured.

Further, since the other end of the connection duct 200 communicates with the refrigerator compartment supply duct 300, the connection duct 200 and the refrigerator compartment supply duct 300 may communicate with each other, at the center of the refrigerator compartment 51.

The refrigerator compartment 51 may be divided into a first storage compartment 51*a* and a second storage compartment 51*b*.

Cold air may be supplied to the second storage compartment 51*b* through a second storage compartment supply duct 400, and the second storage compartment supply duct 400 may be disposed outside the refrigerator case 41.

A foam insulator foams in a space between the inner case 40 and the outer case 10 and fills the space.

The second storage compartment supply duct 400 may be disposed to pass through the space between the inner case 40 and the outer case 10, which foams with the foam insulator, and buried in the space between the inner case 40 and the outer case 10.

Accordingly, as the upper door 20 of the refrigerator 1 is opened, the second storage compartment supply duct 400 disposed outside the refrigerator case 41 may not be exposed outward.

As described above, the rear surface protrusion part 43 protruding toward the inside of the refrigerator case 41 may be disposed on the rear surface 41*a* of the refrigerator case, such that at least a partial area of the connection duct 200 is inserted from the outside of the refrigerator case 41.

In this case, the rear surface protrusion part 43 may be formed to allow the connection duct 200 to be inserted into the rear surface protrusion part 43 as well as allowing at least a partial area of the second storage compartment supply duct 400 to be inserted from the outside of the refrigerator case 41.

The connection duct 200 and the second storage compartment supply duct 400 may be disposed to be adjacent to each other.

For example, the second storage compartment supply duct 400 may be disposed between the connection duct 200, and the other side surface 41*d* of the refrigerator case that is one side surface of the refrigerator compartment 51, with respect to the left-right direction.

Since the second storage compartment supply duct 400 supplies cold air to the second storage compartment 51*b* in a way that the second storage compartment supply duct 400 is inserted from the outside the refrigerator case 41, an area of the second storage compartment 400, protruding toward the inside of the refrigerator compartment 51, may decrease, and the volume of the refrigerator compartment 51 may increase.

Additionally, since the second storage compartment supply duct 400 is disposed to pass through the space between the inner case 40 and the outer case 10, which foams with a foam insulator, an additional insulation member for preventing the heat exchange between the second storage compartment supply duct 400 through which cold air passes and the refrigerator compartment 51 may not be required.

Accordingly, in one embodiment of the present disclosure, a sufficient insulation effect may be produced through the foam insulator that foams between the inner case 40 and the outer case 10 without an additional insulation member for thermally insulating the second storage compartment supply duct 400.

Thus, in one embodiment, since no additional insulation member for providing an insulation effect to the second storage compartment supply duct 400 is required, the thickness of the second storage compartment supply duct 400 may decrease significantly.

Since the thickness of the rear surface protrusion part 43 protruding toward the inside of the refrigerator case 41 decreases significantly, the volume of the refrigerator compartment 51 may increase.

The refrigerator 1 according to the present disclosure may comprise an ice maker 22 at the upper door 20 that opens and closes the refrigerator compartment 51.

Cold air generated from the evaporator 101 may be supplied to the ice maker 22 through an ice maker supply duct 600.

A supply duct inlet 631 may be formed at one end of the ice maker supply duct 600, and communicate with the grille fan assembly 100.

At this time, an ice maker guide duct 800 may be disposed between the ice maker supply duct 600 and the grille fan assembly 100, and allow the ice maker supply duct 600 and the grille fan assembly 100 to communicate with each other.

The ice maker guide duct 800 may change the direction of cold air being discharged from the grille fan assembly 100.

Cold air having circulated in the ice maker 22 may return to the freezer compartment 52 through an ice maker return duct 700.

A return duct outlet 741 may be formed at one end of the ice maker return duct 700, and communicate with the freezer compartment 52.

A return duct inlet 711 may be formed at the other end of the ice maker return duct 700, and communicate with the ice maker 22.

In another example, the ice maker 22 may be dispose at the second upper door 20*b*.

As described above, the upper door 20 comprising the ice maker 22 may be disposed on the front surface of the refrigerator 1.

The ice maker supply duct 600 and the ice maker return duct 700 may be elongated along one side surface 41*e* of the refrigerator case and allow the ice maker 22 and the cold air flow path of the freezer case 42 to communicate with each other.

At this time, one side surface 41*e* of the refrigerator case, passed by the ice maker supply duct 600 and the ice maker return duct 700, may have a relatively low temperature, considering the distribution of the temperature of the entire refrigerator 1.

Accordingly, an imbalance of cold air may occur between one side surface 41*e* of the refrigerator case and the other side surface 41*d* of the refrigerator case.

To reduce the imbalance of cold air in the left-right direction, the connection duct 200 and the second storage compartment supply duct 400 are disposed near the other side surface 41*d* of the refrigerator case, which faces the one side surface 41*e* of the refrigerator case, to ensure a balance of cold air in the entire refrigerator 1.

In relation to this, the refrigerator compartment supply duct 300 may comprise a first refrigerator compartment cold air flow path 321 and a second refrigerator compartment cold air flow path 322 through which cold air guided from the connection duct 200 is branched.

The first refrigerator compartment cold air flow path 321 may have a greater width than the second refrigerator compartment cold air flow path 322, such that more cold air is guided toward the first refrigerator compartment cold air flow path 321.

The second refrigerator compartment cold air flow path 322, to which relatively less cold air is guided, may be disposed closer to one side surface 41*e* of the refrigerator case, where the ice maker supply duct 600 is disposed, than the first refrigerator compartment cold air flow path 321.

Since in the refrigerator compartment supply duct 300, the first refrigerator compartment cold air flow path 321, having a greater width than the second refrigerator compartment cold air flow path 322, is disposed farther from one side surface 41*e* of the refrigerator case where the ice maker supply duct 600 is disposed, a balance of cold air of the entire refrigerator 1 may be ensured.

Further, a flow path opening and closing module 130 may be disposed at the freezer compartment 52, and selectively cut off a supply of cold air generated from the evaporator 101 to the refrigerator compartment 51.

The refrigerator 1 described above may have the following circulation flow of cold air.

Cold air generated from the evaporator 101 in the freezer compartment 52 may be blown to the connection duct 200 that is buried outside the rear surface of the refrigerator compartment 51, by the grille fan assembly 100 disposed at the freezer compartment 52.

The cold air blown to the connection duct 200 may communicate with the refrigerator compartment supply duct 300 disposed inside the rear surface of the refrigerator compartment 51, on the rear surface of the refrigerator compartment 51, and guided to the refrigerator compartment supply duct 300.

The refrigerator compartment supply duct 300 may discharge cold air toward the front surface of the refrigerator compartment 51 in the upper area of the refrigerator compartment 51.

The cold air discharged to the front surface of the refrigerator compartment 51 in the upper area of the refrigerator compartment 51 circulates in the refrigerator compartment 51 and returns to the rear surface of the refrigerator compartment 51 in the lower area of the refrigerator compartment 51.

Since the refrigerator compartment return duct 500 communicates with the lower portion of the rear surface of the refrigerator compartment 51, cold air circulated in the refrigerator compartment 51 may return to the freezer compartment 52 through the refrigerator compartment return duct 500.

Cold air, which is generated from the evaporator 101 disposed at the freezer compartment 52, may be blown to the second storage compartment supply duct 400 buried outside the rear surface of the refrigerator compartment 51, by the grille fan assembly 100 disposed at the freezer compartment 52.

The cold air blown to the second storage compartment supply duct 400 may be discharged to the second storage compartment 51*b*, on the rear surface of the refrigerator compartment 51.

The second storage compartment supply duct 400 may discharge cold air toward the front surface of the second storage compartment 51*b* in the upper area of the second storage compartment 51*b*.

The cold air discharged toward the front surface of the second storage compartment 51*b* in the upper area of the second storage compartment 51*b* circulates in the second storage compartment 51*b* and returns to the rear surface of the second storage compartment 51*b* in the lower area of the second storage compartment 51*b*.

Since the refrigerator compartment return duct 500 communicates with the lower portion of the rear surface of the second storage compartment 51*b*, cold air circulated in the second storage compartment 51*b* may return to the freezer compartment 52 through the refrigerator compartment return duct 500.

A cold air supply duct supplying cold air to the first storage compartment 51*a* and a cold air supply duct supplying cold air to the second storage compartment 51*b* may differ, but cold air having circulated in the first storage compartment 51*a* and cold air having circulated in the second storage compartment 51*b* may both return to the refrigerator compartment return duct 500 that is an identical cold air return duct.

Cold air, which is generated from the evaporator 101 disposed at the freezer compartment 52, may be supplied to the freezer compartment 52, by the grille fan assembly 100 disposed at the freezer compartment 52.

The grille fan assembly 100 may discharge cold air toward the front surface of the freezer compartment 52, in the upper area of the freezer compartment 52.

The cold air discharged toward the front surface of the freezer compartment 52 in the upper area of the freezer compartment 52 circulates in the freezer compartment 52, and returns to the rear surface of the freezer compartment 52, in the lower area of the freezer compartment 52.

Since the machinery room is provided at the rear side of the lower portion of the freezer compartment 52, the rear surface of the lower portion side of the freezer compartment 52 may have an inclined surface that goes upward at a slant.

Accordingly, the cold air returning to the rear surface of the freezer compartment 52, in the lower area of the freezer compartment 52, may be drawn and returned to a freezer compartment cold air return guide part 119 of the grille fan assembly 100 along the inclined surface of the rear surface of the freezer compartment 52.

Figure 10:
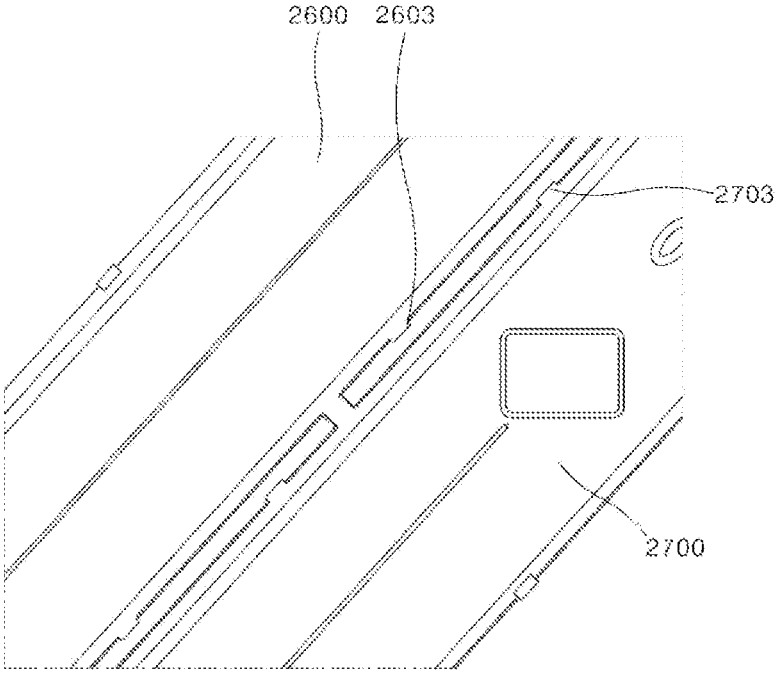
FIG. 10 is a partial enlarged view showing an outer ice maker duct of the refrigerator of one embodiment.

The flow of the supply and return of cold air to the ice maker 22 is described hereafter, with reference to FIG. 10.

Figure 6:
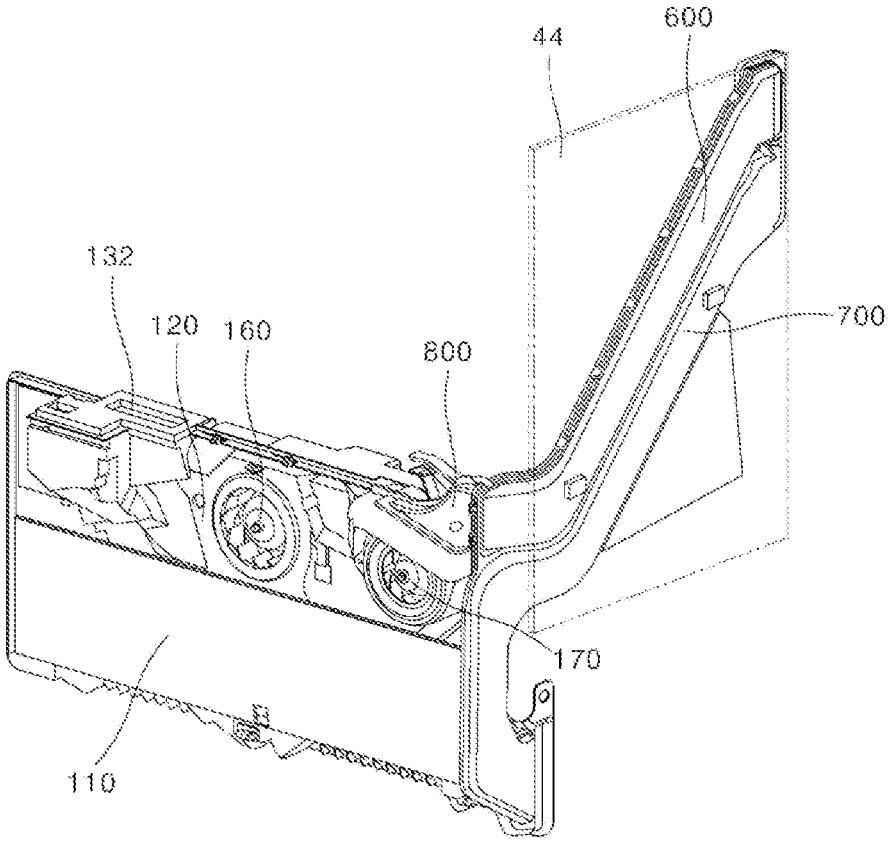
FIG. 6 is a rear perspective view showing that an ice maker duct and a grille fan assembly are coupled in the refrigerator of one embodiment.
Figure 7:
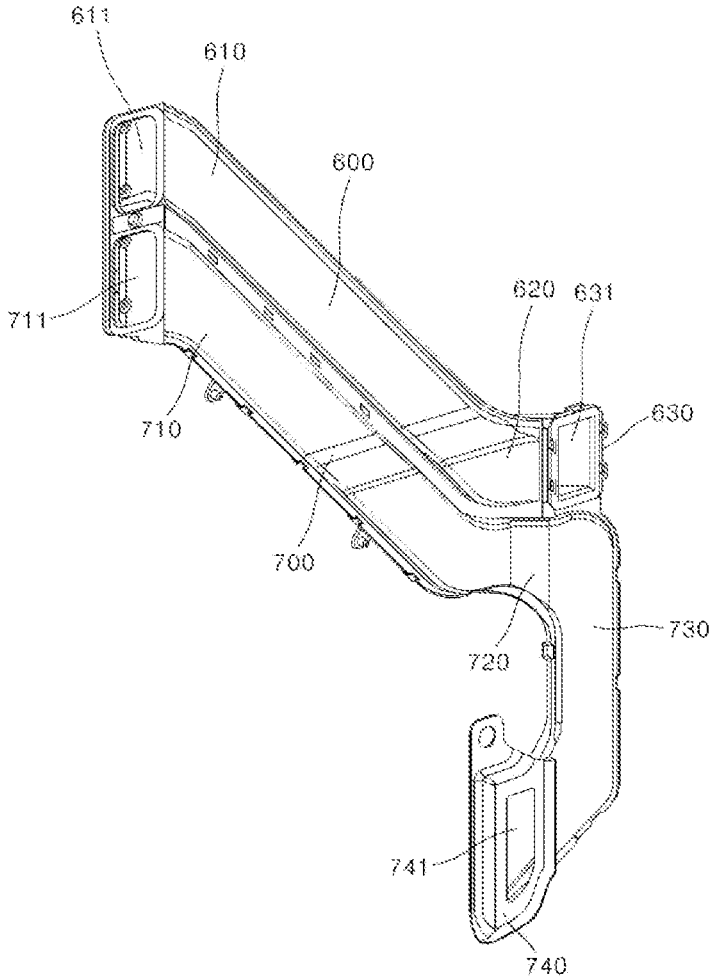
FIG. 7 is a perspective view showing an ice maker duct of the refrigerator of one embodiment.

FIG. 6 is a rear perspective view showing that an ice maker duct and a grille fan assembly are coupled to the refrigerator of one embodiment, and FIG. 7 is a perspective view showing an ice maker duct of the refrigerator of one embodiment.

The grille fan assembly 100 according to the present disclosure may comprise a shroud 120, a grille fan 110, a freezing fan module 160 and an ice making fan module 170.

The shroud 120 may form the exterior of the rear side of the grille fan assembly 100, and the grille fan 110 may form the exterior of the front side of the grille fan assembly 100.

The grille fan 110 may be disposed toward the front surface of the freezer compartment 52, and the shroud 120 may be disposed toward the evaporator 101 that is disposed on the rear surface 42*a* of the freezer case, i.e., on the wall of the rear side of the freezer case 42.

Cold air blown by the freezing fan module 160 is blown to the refrigerator compartment 51 comprising the first storage compartment 51*a* and the second storage compartment 51*b*, and the freezer compartment 52. Cold air blown by the ice making fan module 170 is blown to the ice maker 22.

A vacuum insulator 44 is an insulator, in which a core (usually, glass fibers) that is a porous filler is put into an encapsulant having airtightness, the inside of which enters into a vacuum state, and which exhibits excellent thermal insulation. The vacuum insulator 44 is disposed between the ice maker duct 600, 700 and the outer case 10.

The ice maker guide duct 800 connects to the grille fan assembly 100 and the ice maker supply duct 600, and guides cold air that is blown by the grille fan assembly 100 to the ice maker supply duct 600.

The ice maker duct 600, 700 supplies the cold air that is generated by the evaporator 101 to the ice maker 52 and returns the cold air to the freezer compartment 52. The ice maker duct 600, 700 is disposed in a space between the inner case 40 and the outer case 10, which foams with the foam insulator.

The ice maker duct 600, 700 comprises an ice maker supply duct 600 that guides the cold air generated by the evaporator 101 to the ice maker 22, and an ice maker return duct 700 that supplies the cold air supplied to the ice maker 22 to the freezer compartment 52.

The ice maker supply duct 600 connects to the ice maker guide duct 800 and the ice maker 22, and guides cold air, which is generated by the evaporator 101 and blown by the grille fan assembly 100, to the ice maker 22.

The ice maker supply duct 600 is disposed on one side surface 41*e* of the refrigerator case and one side surface 42*e* of the freezer case. The ice maker supply duct 600 may be disposed on the other side surface 41*d* of the refrigerator case and the other side surface 42*d* of the freezer case, depending on the position of the door 20*a*, 20*b* at which the ice maker 22 is disposed.

The ice maker supply duct 600 is formed approximately into a rectangular thin plate. The ice maker supply duct 600 is formed into a elongated plate, and disposed diagonally by crossing from the rear of the upper portion of one side surface 42*e* of the freezer case to the front of the middle portion of one side surface 41*e* of the refrigerator case. Since the ice maker supply duct 600 needs to have the shortest distance, the ice maker supply duct 600 is disposed diagonally, preferably. The ice maker supply duct 600 is formed into a rectangular long slit having a cross section where a left-right width is less than an up-down width.

The ice maker supply duct 600 is disposed near a portion of the ice maker return duct 700 side by side. The ice maker supply duct has a supply duct inlet 631, at the rear end of the lower portion thereof, and has a supply duct outlet 611, at the front end of the upper portion thereof. Cold air generated by the evaporator 101 is drawn into the supply duct inlet 631, and the supply duct outlet 611 discharges cold air to the ice maker 22.

The ice maker supply duct 600 comprises a supply duct inclination part 610 that has a supply duct outlet 611 discharging cold air to the ice maker 22 and is disposed near a return duct inclination part 710 side by side, a supply duct bend part 620 that connects to the supply duct inclination part 610, bends and is disposed near the return duct bend part 720 side by side, and a supply duct connection part 630 that has a supply duct inlet 631 which connects to the supply duct bend part 620 and into which cold air generated by the evaporator 101 is drawn.

A portion of the supply duct inclination part 610, where the supply duct outlet 611 is formed, bends toward the inside (in a direction farther from the outer case 10) of the refrigerator compartment 51, such that a surface formed by the supply duct outlet 611 is formed in parallel with a surface substantially formed by one side surface 41*e* of the refrigerator case. That is, the supply duct inclination part 610 bends to enable the supply duct outlet 611 to face the other side surface 41*d* of the refrigerator case. The supply duct inclination part 610 is entirely disposed diagonally in the lengthwise direction thereof, and the portion of the supply duct inclination part 610, where the supply duct outlet 611 is formed, is formed in the horizontal direction.

The supply duct bend part 620 bends toward the inside of the refrigerator compartment 51 (in a direction farther from the outer case 10). The supply duct bend part 620 is formed in the horizontal direction and bends with respect to the vertical direction.

The supply duct connection part 630 connects to the ice maker guide duct 800. The surface of the supply duct connection part 630, which is formed by the supply duct inlet 631, is formed in parallel with the surface which is substantially formed by one side surface 41*e* of the refrigerator case. That is, the supply duct connection part 630 is formed in a way that the supply duct inlet 631 faces the other side surface 41*d* of the refrigerator case.

The ice maker return duct 700 connects to the ice maker 22 and the freezer case 42 and returns cold air of the ice maker 22 to the freezer compartment 52.

The ice maker return duct 700 is disposed on one side surface 41*e* of the refrigerator case and one side surface 42*e* of the freezer case. The ice maker return duct 700 may be disposed on the other side surface 41*d* of the refrigerator case and the other side surface 42*d* of the freezer case, depending on the position of the door 20*a*, 20*b* at which the ice maker 22 is disposed.

The ice maker return duct 700 is formed into a thin plate, and elongated in the lengthwise direction. When viewed laterally, the upper portion of the ice maker return duct 700 is formed diagonally, while the lower portion is formed in a straight line shape.

The upper portion of the ice maker return duct 700 is disposed diagonally by crossing from the rear of the upper portion of one side surface 42*e* of the freezer case to the front of the middle portion of one side surface 41*e* of the refrigerator case. The ice maker return duct 700 needs to have the shortest distance, but the upper portion of the ice maker return duct 700 may only be disposed diagonally to minimize the size of the vacuum insulator 44. The lower portion of the ice maker return duct 700 is elongated and formed from the rear of one side surface 42*e* of the freezer case in the vertical direction. When viewed from above, the ice maker return duct 700 is formed into a fault, in a way that the lower portion of the ice maker return duct 700 bends from the upper portion of the ice maker return duct 700 toward the other side surface 42*d* of the freezer case (the inside of the freezer compartment 52). The lower portion of the ice maker return duct 700 is elongated and formed diagonally to the lower side of the front thereof, at the lower end thereof.

The ice maker return duct 700 is formed into a rectangular long slit having a cross section where a left-right width is less than an up-down width.

A portion of the ice maker return duct 700 is disposed near the ice maker supply duct 600 side by side. The ice maker return duct 700 bends in a portion adjacent to the supply duct inlet 631, to form a fault. The ice maker return duct 700 bends in a portion adjacent to the portion where the ice maker supply duct 600 connects to the ice maker guide duct 800, to form a fault.

The ice maker return duct 700 has a return duct inlet 711 that discharges cold air to the ice maker 22, at the front end of the upper portion thereof, and has a return duct outlet 741 that discharges cold air to the freezer compartment 52, at the front end of the lower portion thereof.

The ice maker return duct 700 comprises a return duct inclination part 710 that has a return duct inlet 711 into which cold air of the ice maker 22 is drawn and is disposed diagonally by crossing from the front of the refrigerator case 41 to the rear of the freezer case 42, a return duct bend part 720 that connects to the return duct inclination part 710 and bends from one side surface 42*e* of the freezer case toward the other side surface 42*d* of the freezer case (the inside of the freezer compartment 52), a return duct vertical part 730 that connects to the return duct bend part 720 and is disposed vertically, and a return duct connection part 740 that has a return duct outlet 741 connects to the return duct vertical part 730 and discharges cold air to the freezer compartment.

The return duct inclination part 710 is disposed near the supply duct inclination part 610 side by side. The portion of the return duct inclination part 710, wherein the return duct inlet 711 is formed, bends toward the inside of the refrigerator compartment 51 (in a direction farther from the outer case 10), such that a surface formed by the return duct inlet 711 is formed in parallel with a surface substantially formed by one side surface 41*e* of the refrigerator case. That is, the return duct inclination part 710 bends in a way that the return duct inlet 711 faces the other side surface 41*d* of the refrigerator case. The return duct inclination part 710 is entirely disposed diagonally in the lengthwise direction, and the portion where the return duct inlet 711 is formed is formed in the horizontal direction.

The return duct bend part 720 bends toward the inside of the refrigerator compartment 51 (in a direction farther from the outer case 10). The return duct bend part 720 is formed horizontally, and bends with respect to the vertical direction.

The return duct vertical part 730 is elongated in the vertical direction (in the lengthwise direction). When viewed from above, the return duct vertical part 730 is formed into a fault together with the return duct inclination part.

The return duct connection part 740 is elongated to the lower side of the front of the return duct vertical part 730 diagonally, at the lower end of the return duct vertical part 730. The return duct connection part 740 connects to the refrigerator case 41. A surface formed by the return duct outlet 741 of the return duct connection part 740 is formed in parallel with a surface substantially formed by one side surface 41*e* of the refrigerator case. That is, the return duct connection part 740 is formed in a way that the return duct outlet 741 faces the other side surface 41*d* of the refrigerator case.

Figure 8:
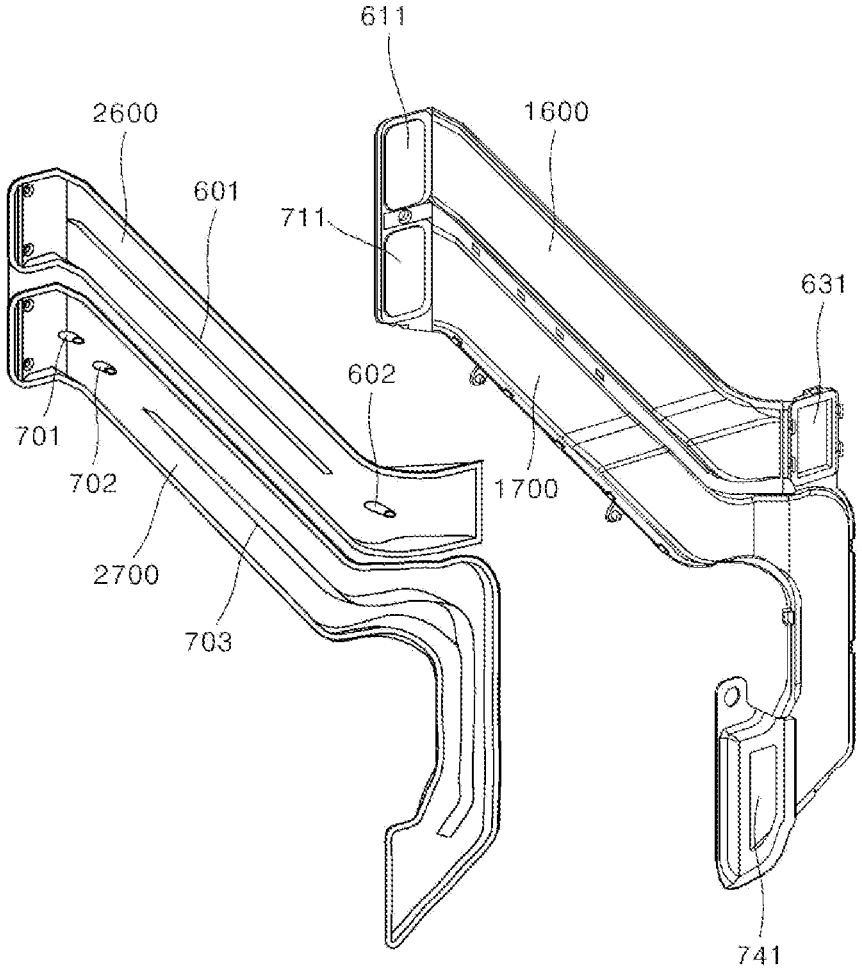
FIG. 8 is an exploded perspective view showing the ice maker duct of the refrigerator of one embodiment.
Figure 9:
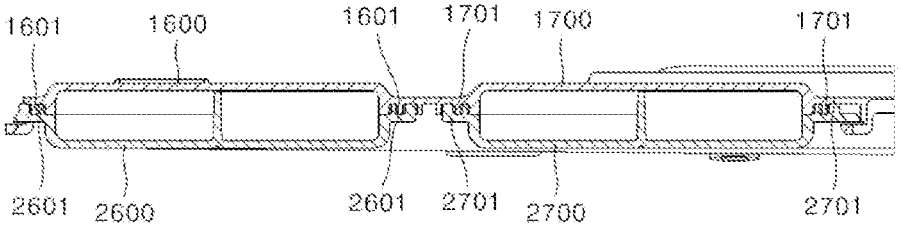
FIG. 9 is a cross-sectional view showing the ice maker duct of the refrigerator of one embodiment.
Figure 11:
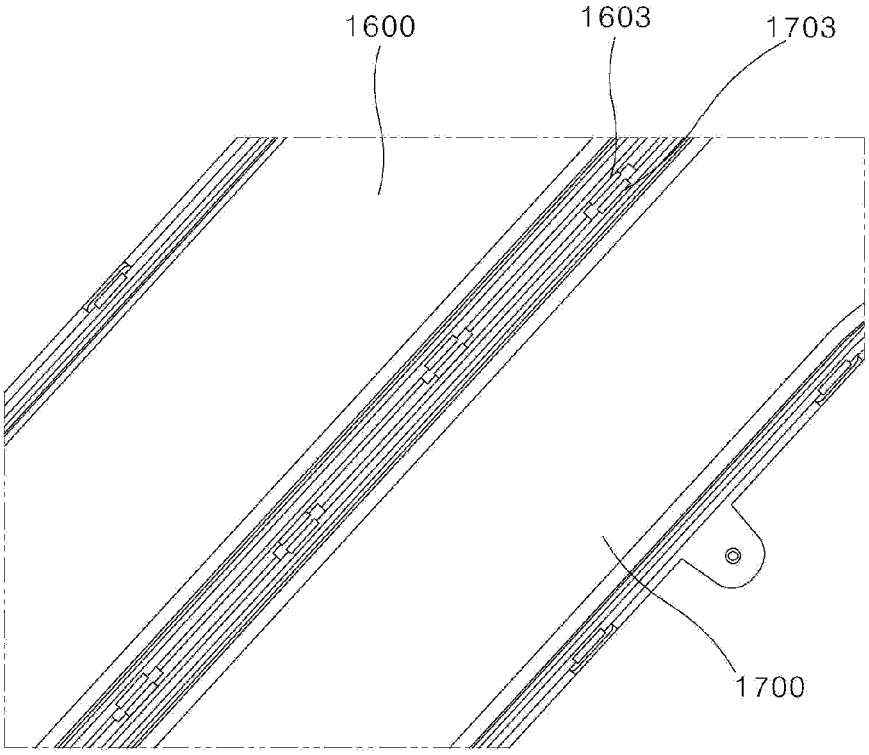
FIG. 11 is a partial enlarged view showing an inner ice maker duct of the refrigerator of one embodiment.

FIG. 8 is an exploded perspective view showing the ice maker duct of the refrigerator of one embodiment, FIG. 9 is a cross-sectional view showing the ice maker duct of the refrigerator of one embodiment, FIG. 10 is a partial enlarged view showing an outer ice maker duct of the refrigerator of one embodiment, and FIG. 11 is a partial enlarged view showing an inner ice maker duct of the refrigerator of one embodiment.

The ice maker duct 600, 700 comprises an inner ice maker duct 1600, 1700 and an outer ice maker duct 2600, 2700 that are divided by a vertical surface formed in the direction where cold air flows.

The inner ice maker duct 1600, 1700 has an inner convex concave part 1601, 1701 that is formed convexly and concavely, at the edge thereof, and the outer ice maker duct 2600, 2700 has an outer convex concave part 2601, 2701 that is formed convexly and concavely and engages with the inner convex concave part 1601, 1701, at the edge thereof. The convex concave structures that are formed convexly and concavely are assembled to each other such that a foam insulator cannot be drawn between the inner ice maker duct 1600, 1700 and the outer ice maker duct 2600, 2700.

A hook 2603, 2703 is formed at any one of the inner ice maker duct 1600, 1700 and the outer ice maker duct 2600, 2700, and a hook hole 1603, 1703 to which the hook 2603, 2703 is fastened is formed at the other of the inner ice maker duct 1600, 1700 and the outer ice maker duct 2600. Referring to FIGS. 10 and 11, in the embodiment, the hook 2603, 2703 is formed at the outer ice maker duct 2600, 2700, and the hook hole 1603, 1703 is formed at the inner ice maker duct 1600, 1700. A plurality of hooks 2603, 2703 and a plurality of hook holes 1603, 1703 are provided and spaced from each other.

The inner ice maker duct 1600, 1700 is disposed on one side surface 41*e* of the refrigerator case and one side surface 42*e* of the freezer case.

The inner ice maker duct 1600, 1700 has a supply duct inlet 621 into which cold air generated by the evaporator is drawn, a supply duct outlet 611 that discharge cold air to the ice maker 22, a return duct inlet 711 into which cold air of the ice maker 22 is drawn, and a return duct outlet 741 that discharges cold air to the freezer compartment 52.

The inner ice maker duct 1600, 1700 comprises an inner ice maker supply duct 1600 forming a flow path through which cold air is supplied from the evaporator 101 to the ice maker 22, and an inner ice maker return duct 1700 forming a flow path through which cold air returns from the ice maker 22 to the freezer compartment 52.

The supply duct inlet 621 and the supply duct outlet 611 are formed at the inner ice maker supply duct 1600, and the return duct inlet 711 and the return duct outlet 741 are formed at the inner ice maker return duct 1700.

The inner ice maker supply duct 1600 is disposed near a portion of the inner ice maker return duct 1700 side by side. The inner ice maker return duct 1700 is connected to and disposed at the lower side of the inner ice maker supply duct 1600.

The inner ice maker supply duct 1600 and the inner ice maker return duct 1700 have an inner supply convex concave part 1601 and an inner return convex concave part 1701, therebetween, and the inner supply convex concave part 1601 and the inner return convex concave part 1701 are formed convexly and concavely, engage with each other and are spaced from each other side by side.

The outer ice maker supply duct 2600 is spaced from the outer case 10.

The outer ice maker duct 2600, 2700 has a cold air rib 601, 703 therein, and has a cold air projection 602, 701, 702 at a cold air inflow side thereof. The cold air rib 601, 703 protrudes inward and is formed in a long strap shape in a lengthwise direction that is the direction where cold air flows. The cold air projection 602, 701, 702 protrudes in a pillar shape and has a cross section of an oval shape, a wing shape or an arch shape.

The cold air rib 601, 703 guides the flow of cold air. The cold air rib 601, 703 is pressed in a direction in which the thickness of the ice maker duct 600, 700 is thin, as the foam insulator foams, to prevent the cold air flow path from narrowing. The cold air projection 602, 701, 702 distributes cold air flowing through the cold air rib 601, 703, to prevent the cold air rib 601, 703 from acting as frictional resistance of the flow path.

The outer ice maker duct 2600, 2700 comprises an outer ice maker supply duct 2600, and an outer ice maker return duct 2700. The outer ice maker supply duct 2600 forms a flow path through which cold air is supplied from the evaporator 101 to the ice maker 22, and the outer ice maker return duct 2700 forms a flow path through which cold air returns from the ice maker 22 to the freezer compartment 52.

The cold air supply projection 602 protruding in a pillar shape in the direction where cold air is supplied, and the cold air supply rib 601 protruding inward in a long strap shape in the lengthwise direction are spaced from each other and disposed consecutively, at the outer ice maker supply duct 2600.

The cold air return projection 701 protruding in a pillar shape in the direction where cold air returns, and the cold air return rib 703 protruding inward in a long strap shape in the lengthwise direction are spaced from each other and disposed consecutively, at the outer ice maker return duct. A plurality of cold air return projections 701 may be provided and spaced from each other.

The outer ice maker supply duct 2600 is disposed near a portion of the outer ice maker return duct 270 side by side. The outer ice maker return duct 2700 connects to and is disposed at the lower side of the outer ice maker supply duct 2600.

The outer ice maker supply duct 2600 and the outer ice maker return duct 2700 have an outer supply convex concave part 2601 and an outer return convex concave part 2701, therebetween, and the outer supply convex concave part 2601 and the outer return convex concave part 2701 are formed convexly and concavely, engage with each other, and are spaced from each other side by side.

A hook 2603, 2703 is formed in any one of the space between the inner ice maker supply duct 1600 and the inner ice maker return duct 1700, and the space between the outer ice maker supply duct 2600 and the outer ice maker return duct 2700, and a hook hole 1603, 1703 to which the hook 2603, 2703 is fastened is formed in the other space. Referring to FIGS. 10 and 11, in the embodiment, the hook 2603, 2703 is formed between the outer ice maker supply part 2600 and the outer ice maker return duct 2700, and the hook hole 1603, 1703 is formed between the inner ice maker supply duct 1600 and the inner ice maker return duct 1700.

Figure 12:
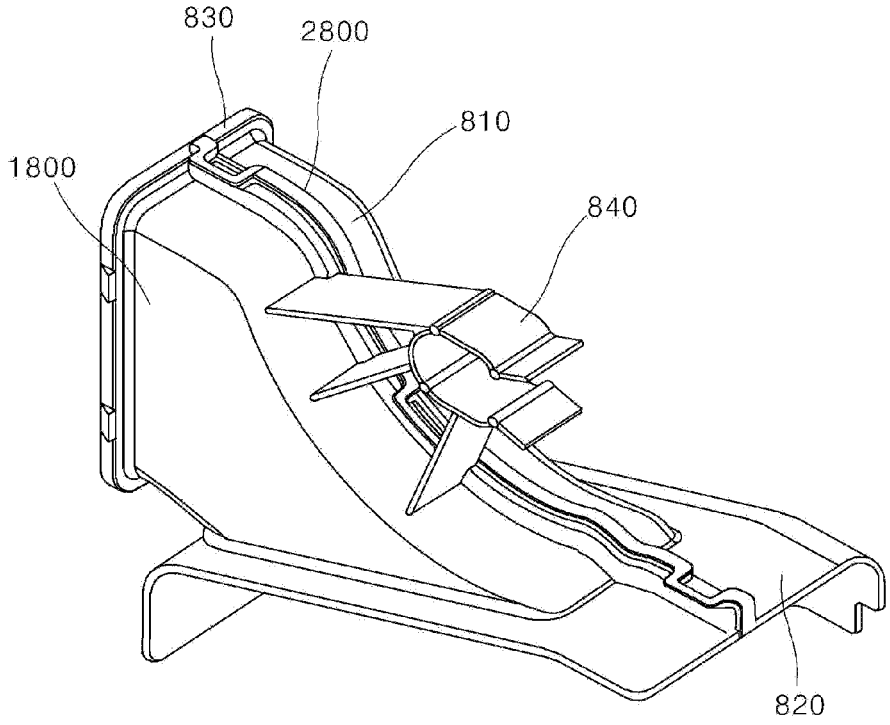
FIG. 12 is a perspective view showing an ice maker guide duct of the refrigerator of one embodiment.
Figure 13:
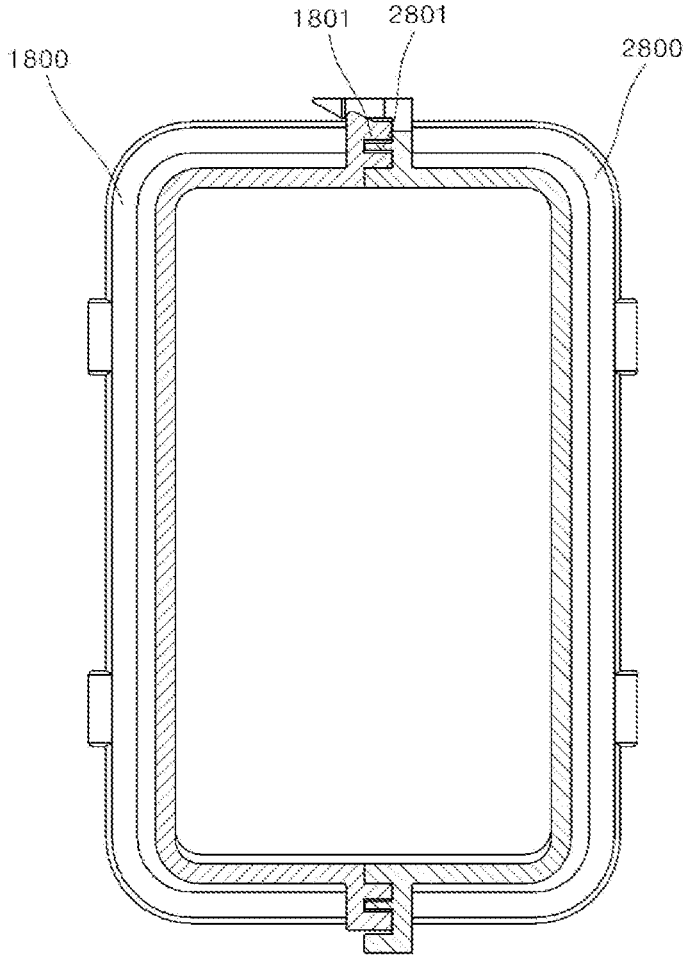
FIG. 13 is a cross-sectional view showing the ice maker guide duct of the refrigerator of one embodiment.
Figure 14:
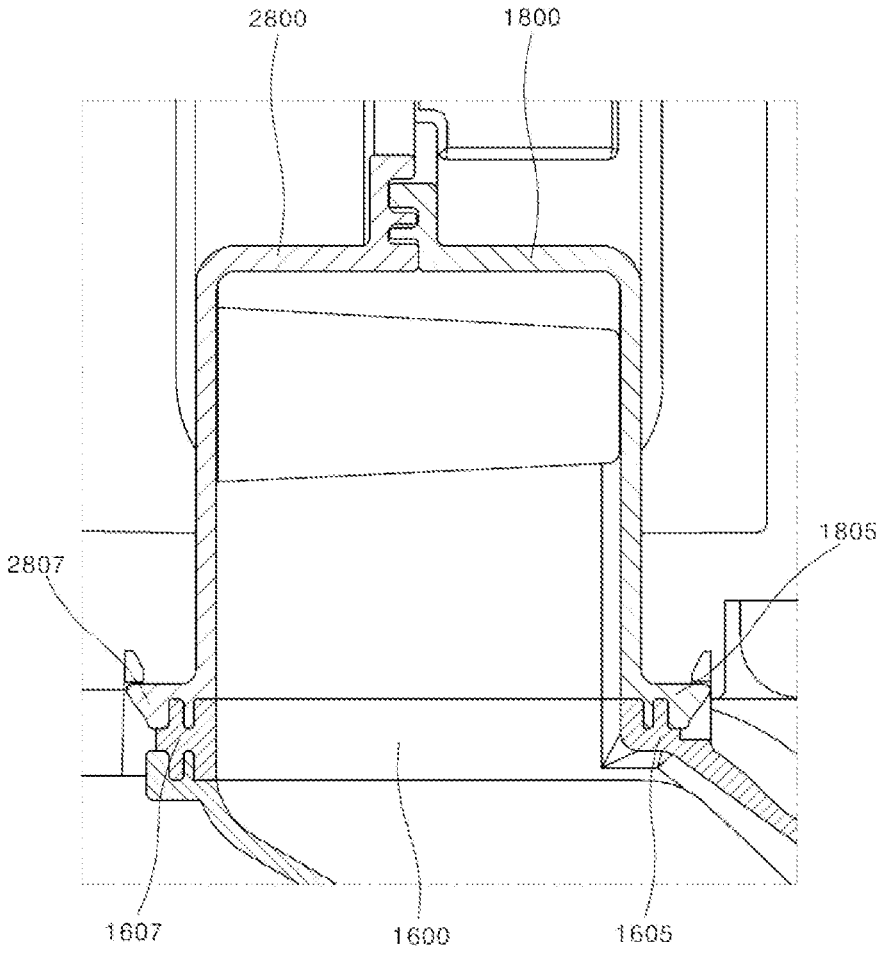
FIG. 14 is a partial cross-sectional view showing the ice maker duct and the ice maker guide duct of the refrigerator of one embodiment.

FIG. 12 is a perspective view showing an ice maker guide duct of the refrigerator of one embodiment, FIG. 13 is a cross-sectional view showing the ice maker guide duct of the refrigerator of one embodiment, and FIG. 14 is a partial cross-sectional view showing the ice maker duct and the ice maker guide duct of the refrigerator of one embodiment.

The ice maker guide duct 800 comprises a guide main body 810 through which cold air flows, a guide duct connection part 830 which connects to the ice maker duct 600, 700, a guide assembly connection part 820 which connects to the grille fan assembly 100, and a guide support member 840 which supports the guide main body 810, and at a time when the foam insulator foams, prevents the deformation of the guide main body 810.

The ice maker guide duct 800 comprises an inner guide duct 1800 and an outer guide duct 2800 that are divided by a vertical surface formed in the direction where cold air flows.

The inner guide duct 800 has an inner guide convex concave part 1801 that is formed convexly and concavely, at the edge thereof, and the outer guide duct 2800 has an outer guide convex concave part 2801 that is formed convexly and concavely and engages with the inner guide convex concave part 1801, at the edge thereof. The convex concave structures are assembled to each other, such that the foam insulator cannot be drawn between the inner guide duct 1800 and the outer guide duct 2800.

The inner guide duct 1800 is disposed on the rear surface 42*a* of the freezer case, and the outer guide duct 2800 is spaced and disposed apart from the outer case 10.

The inner guide duct 1800 connects to the inner ice maker duct 1600, 1700, and the outer guide duct 2800 connects to the outer ice maker duct 2600, 2700. A guide engagement convex concave part 1805, 2807 is formed at the edge of the ice maker guide duct 800, which connects to the ice maker duct 600, 700, and a duct engagement convex concave part 1605, 1607 is formed at the inner ice maker supply duct 1600 of the ice maker duct 600, 700 and engages with the guide engagement convex concave part 1805, 2807. An inner guide engagement convex concave part 1805 is formed at the inner guide duct 1800, and an outer guide engagement convex concave part 2807 is formed at the outer guide duct 2800. The convex concave structures are assembled to each other, to prevent the foam insulator from being drawn between the ice maker guide duct 800 and the inner ice maker supply duct 1600.

Figure 15:
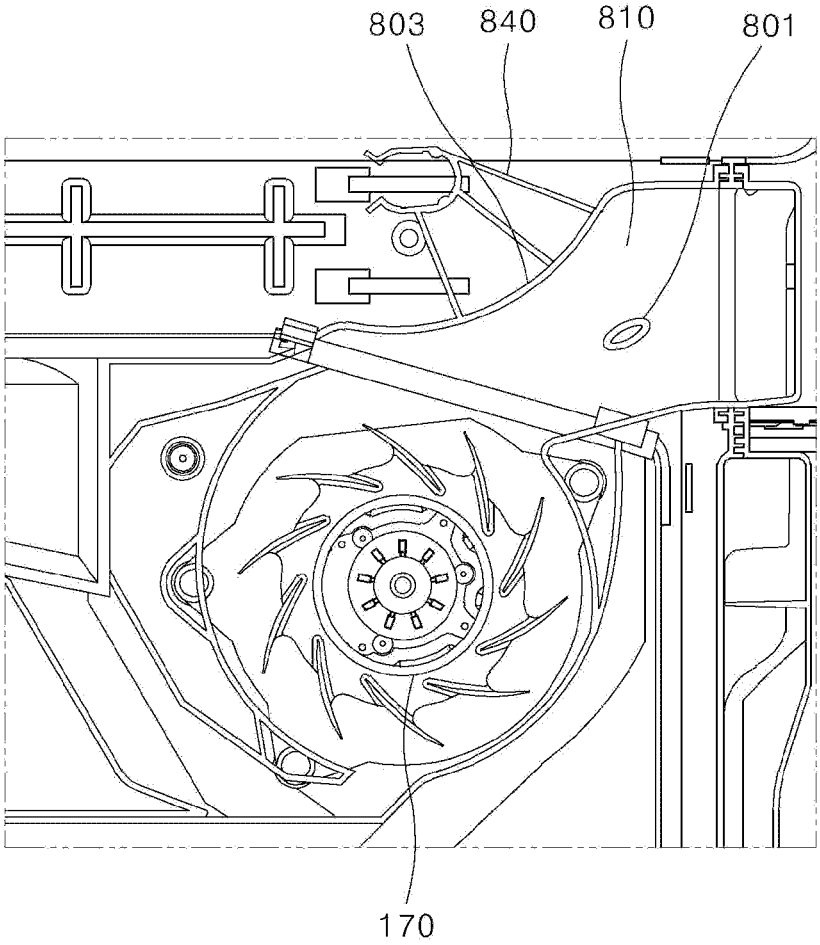
FIG. 15 is a partial cross-sectional view showing the refrigerator of one embodiment.

FIG. 15 is a partial cross-sectional view showing the refrigerator of one embodiment.

The bend of the guide duct 800 has a guide surface 803 the bend of which is formed in a direction opposite to the direction of the bend that is formed based on the rotation of the ice making fan module 170 and which guides the cold air that is blown by the ice making fan module 170 diagonally in the upward direction. A circle formed by the guide surface 803 and the ice making fan module 170 has an inflection point. The guide surface 803 has an arc-shaped cross section, and preferably, a tangent line connecting the center of the arc and the edge of the arc has a 45-degree gradient.

The inner guide duct 1800 has a guide projection 801 that protrudes in a pillar shape. The guide projection 801 has an oval-shaped cross section, a wing-shaped cross section or an arch-shaped cross section. The guide projection 801 distributes cold air flowing to the cold air rib 601, 703, such that the cold air rib 601, 703 of the ice maker duct 600, 700 does not act as frictional resistance of a flow path.

Figure 16:
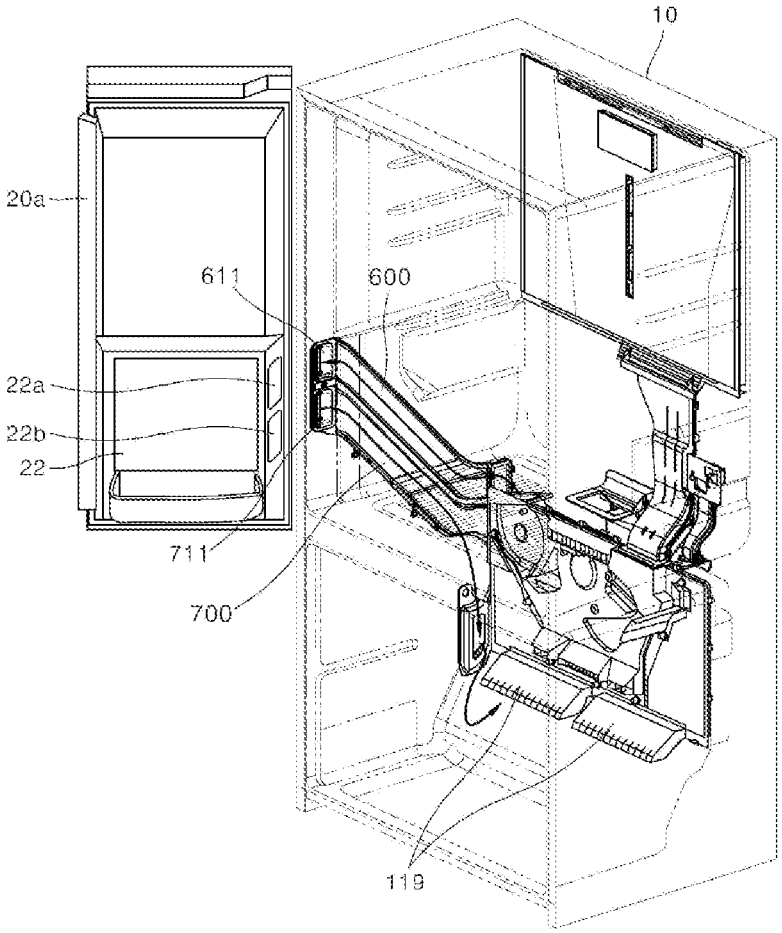
FIG. 16 is a view showing a structure for supplying and returning cold air to the ice maker of the refrigerator of one embodiment.

FIG. 16 is a view showing a structure for supplying and returning cold air to the ice maker of the refrigerator of one embodiment.

Cold air generated from the evaporator 101 may be supplied to the ice maker 22 that is disposed at the first upper door 20*a* disposed on the front surface of the refrigerator 1, through the ice maker supply duct 600.

One end of the ice maker supply duct 600 may communicate with the grille fan assembly 100. The other end of the ice maker supply duct 600 may communicate with the ice maker 22.

Cold air having circulated in the ice maker 22 may return to the freezer compartment 52 through the ice maker return duct 700.

One end of the ice maker return duct 700 may communicate with the freezer compartment 52. The other end of the ice maker return duct 700 may communicate with the ice maker 22.

The ice maker 22's cold air having returned to the freezer compartment 52 may return through the freezer compartment cold air return guide part 119 that is disposed under the lower portion of the grille fan assembly 100 of the freezer compartment 52.

As described above, a cold air supply duct supplying cold air to the freezer compartment 52 and a cold air supply duct supplying cold air to the ice maker 22 are different, but cold air having circulated in the freezer compartment 52 and cold air having circulated in the ice maker 22 may both return to the refrigerator cold air return guide part 119.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

Advantages of the subject matter of the present disclosure are not limited to the advantages described above, and other advantages that are not mentioned above can be clearly understood by one having ordinary skill in the art, based on the details of the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a refrigerator case configured to form a refrigerator compartment;

a freezer case disposed at a lower side of the refrigerator case and configured to form a freezer compartment;

a door at a front of the refrigerator case to open and close the refrigerator case;

an ice maker disposed at the door to provide ice;

an evaporator disposed at a rear of the freezer case to provide cold air; and an ice maker duct configured to supply the cold air from the evaporator to the ice maker, and to return the cold air from the ice maker to the freezer compartment, wherein the ice maker duct includes an inner ice maker duct and an outer ice maker duct that are separated by a surface provided in a direction in which the cold air is to flow, the inner ice maker duct includes an inner convex concave part at an edge of the inner ice maker duct, and the outer ice maker duct includes an outer convex concave part at an edge of the outer ice maker duct, and the outer convex concave part to convexly and concavely engage with the inner convex concave part.

2. The refrigerator of claim 1, wherein the inner ice maker duct includes:

a supply duct inlet configured to receive the cold air from the evaporator, a supply duct outlet configured to discharge the cold air from the inner ice maker duct to the ice maker, a return duct inlet configured to receive the cold air from the ice maker, and a return duct outlet configured to discharge the cold air from the inner ice maker duct to the freezer compartment.

3. The refrigerator of claim 2, the inner ice maker duct comprising:

an inner ice maker supply duct configured to provide a flow path for the cold air from the evaporator to be supplied to the ice maker; and an inner ice maker return duct configured to provide a flow path for the cold air from the ice maker to be provided to the freezer compartment, wherein the supply duct inlet is disposed at a first end of the inner ice maker supply duct, and the supply duct outlet is disposed at a second end of the inner ice maker supply duct, and the return duct inlet is disposed at a first end of the inner ice maker return duct, and the return duct outlet is disposed at a second end of the inner ice maker return duct.

4. The refrigerator of claim 3, wherein the inner ice maker return duct is connected to a lower side of the inner ice maker supply duct.

5. The refrigerator of claim 1, wherein the outer ice maker duct includes a rib to protrude inward and along a direction in which the cold air flows.

6. The refrigerator of claim 1, wherein the outer ice maker duct includes a projection to protrude in a pillar shape, at a cold air inflow side of the outer ice maker duct.

7. The refrigerator of claim 1, the outer ice maker duct comprising:

an outer ice maker supply duct configured to provide a flow path for the cold air from the evaporator to be supplied to the ice maker; and an outer ice maker return duct configured to provide a flow path for the cold air from the ice maker to be provided to the freezer compartment, wherein the outer ice maker supply duct includes a projection to protrude in a pillar shape in a direction in which the cold air is supplied, and a rib to protrude inward and along a lengthwise direction of the outer ice maker supply duct, the rib being spaced from the protrusion, and the outer ice maker return duct includes a projection to protrude in a pillar shape, and a rib to protrude inward and along the lengthwise direction of the outer ice maker return duct, the rib being spaced from the protrusion.

8. The refrigerator of claim 7, wherein the outer ice maker return duct is connected to a lower side of the outer ice maker supply duct.

9. The refrigerator of claim 1, the inner ice maker duct comprising;

an inner ice maker supply duct configured to provide a flow path for the cold air from the evaporator to be supplied to the ice maker; and an inner ice maker return duct configured to provide a flow path for the cold air from the ice maker to be provided to the freezer compartment, wherein the inner ice maker supply duct includes an inner supply convex concave part, and the inner ice maker return duct includes an inner return convex concave part, and the inner return convex concave part is convexly and concavely provided between the inner ice maker supply duct and the inner ice maker return duct, and the inner supply convex concave part is convexly and concavely provided between the inner ice maker supply duct and the inner ice maker return duct.

10. The refrigerator of claim 1, the outer ice maker duct comprising:

an outer ice maker supply duct configured to provide a flow path for the cold air from the evaporator to be supplied to the ice maker; and an outer ice maker return duct configured to provide a flow path for the cold air from the ice maker to be provided to the freezer compartment, wherein the outer ice maker supply duct includes an outer supply convex concave part, and the outer ice maker return duct includes an outer return convex concave part, and the outer return convex concave part is convexly and concavely provided between the outer ice maker supply duct and the outer ice maker return duct, and the outer supply convex concave part is convexly and concavely provided between the outer ice maker supply duct and the outer ice maker return duct.

11. The refrigerator of claim 1, wherein one of the inner ice maker duct and the outer ice maker duct includes a hook, and the other one of the inner ice maker duct and the outer ice maker duct includes a hook hole to which the hook is to fasten.

12. The refrigerator of claim 1, the inner ice maker duct comprising:

an inner ice maker supply duct configured to provide a flow path for the cold air from the evaporator to be supplied to the ice maker; and an inner ice maker return duct configured to provide a flow path for the cold air from the ice maker to be provided to the freezer compartment, the outer ice maker duct comprising:

an outer ice maker supply duct configured to provide a flow path for the cold air from the evaporator to be supplied to the ice maker; and an outer ice maker return duct configured to provide a flow path for the cold air from the ice maker to be provided to the freezer compartment, wherein a hook is provided at one of between the inner ice maker supply duct and the inner ice maker return duct, or between the outer ice maker supply duct and the outer ice maker return duct, and a hook hole is provided at the other one.

13. The refrigerator of claim 1, further comprising:

a grille fan assembly to blow the cold air provided by the evaporator; and an ice maker guide duct to couple to the ice maker duct and the grille fan assembly, and configured to guide the cold air from the grille fan assembly to the ice maker duct, wherein the ice maker guide duct includes an inner guide duct and an outer guide duct that are separated by a surface provided along a direction in which the cold air is to flow.

14. The refrigerator of claim 13, wherein the inner guide duct include an inner guide convex concave part at an edge of the inner guide duct, and the outer guide duct includes an outer guide convex concave part at an edge of the outer guide duct, and the outer guide convex concave part is to convexly and concavely engage with the inner guide convex concave part.

15. The refrigerator of claim 13, wherein the ice maker guide duct includes a guide engagement convex concave part at an edge of the ice maker guide duct, and the guide engagement convex concave part to couple to the ice maker duct, and the ice maker duct includes a duct engagement convex concave part to engage with the guide engagement convex concave part.

16. The refrigerator of claim 13, wherein the grille fan assembly includes an ice making fan module disposed at a side of the grill fan assembly to blow the cold air to the guide duct, and the guide duct has a bend formed in a direction opposite to a bend that is formed based on a rotation of the ice making fan module and which guides the cold air blown by the ice making fan module.

17. A refrigerator, comprising:

a refrigerator case configured to form a refrigerator compartment;

a freezer case configured to form a freezer compartment;

a door to open and close the refrigerator case;

an ice maker disposed at the door to provide ice;

an evaporator disposed at the freezer case to provide cold air; and an ice maker duct configured to supply the cold air to the ice maker and to return the cold air to the freezer compartment, wherein the ice maker duct includes an inner ice maker duct and an outer ice maker duct, the inner ice maker duct includes an inner part, and the outer ice maker duct includes an outer part to convexly and concavely engage with the inner part of the inner ice maker duct.

18. The refrigerator of claim 17, wherein the inner ice maker duct includes:

a supply duct inlet into which the cold air from the evaporator is provided, a supply duct outlet configured to discharge the cold air to the ice maker, a return duct inlet configured to receive the cold air from the ice maker, and a return duct outlet configured to discharge the cold air to the freezer compartment.

19. The refrigerator of claim 18, the inner ice maker duct comprising:

an inner ice maker supply duct configured to provide a flow path for the cold air from the evaporator to be supplied to the ice maker; and an inner ice maker return duct configured to provide a flow path for the cold air from the ice maker to be provided to the freezer compartment.

20. The refrigerator of claim 19, the outer ice maker duct comprising:

an outer ice maker supply duct configured to provide a flow path for the cold air from the evaporator to be provided to the ice maker; and an outer ice maker return duct configured to provide a flow path for the cold air from the ice maker to be supplied to the freezer compartment, wherein the outer ice maker supply duct includes a projection, and a rib to protrude inward and along a lengthwise direction of the outer ice maker supply duct, the rib being spaced from the protrusion, and the outer ice maker return duct includes a projection, and a rib to protrude inward and along the lengthwise direction of the outer ice maker return duct, the rib being spaced from the protrusion.

* * * * *